United States Patent [19]

Grabovac et al.

[11] Patent Number: 4,709,602

[45] Date of Patent: Dec. 1, 1987

[54] HAND GRIP DRIVE FOR TORQUE WRENCHES

[75] Inventors: Bosko Grabovac, Arcadia; Zlatko Kurtovic, Walnut, both of Calif.

[73] Assignee: Consolidated Devices, Inc., City of Industry, Calif.

[21] Appl. No.: 3,862

[22] Filed: Jan. 16, 1987

[51] Int. Cl.[4] ..... B25B 23/159

[52] U.S. Cl. ..... 81/483; 81/177.1; 81/177.6

[58] Field of Search ..... 81/483, 489, 478, 177.1, 81/177.2, 177.6, 177.85, 467, 480, 481

[56] References Cited

U.S. PATENT DOCUMENTS

| | | | |
|---|---|---|---|
| 2,768,547 | 10/1956 | Noell | 81/480 |
| 3,165,014 | 1/1965 | Grabovac | 81/483 |
| 3,581,606 | 5/1969 | Grabovac | 81/483 |
| 3,772,942 | 11/1973 | Grabovac | 81/483 |

*Primary Examiner*—Frederick R. Schmidt
*Assistant Examiner*—Robert Showalter
*Attorney, Agent, or Firm*—Georges A. Maxwell

[57] ABSTRACT

Improved, manually-operable, adjusting mechanisms for click-type, adjustable torque wrenches which include manually-engageable, resilient, plastic, tubular handgrips slidably engaged about the rear end portions of elongate, tubular, metal wrench lever arms and which are shiftable longitudinally from normal, forward positions in rotary-driving engagement with the arms to actuated rear positions out of rotary-driving engagement with the arm. The invention resides in an improved locking mechanism releaseably locking the grip in rotary-driving engagement with the arm when in its normal position and yieldingly permitting rotation of the grip relative to the arm when turning forces between the arm and grip exceed the shear strength of the material of which the grip is made. The locking means include a plurality of circumferentially-spaced, inside flats about the exterior of the arm and a plurality of circumferentially-spaced, outside flats about the interior of the grip normally establishing flat bearing and rotary-driving engagement with the inner flats when the grip is in its normal position. The adjacent inner flates define cam edges to engage the surfaces of the outside flats and to yieldingly expand the grip when forceably rotated relative to the arm.

8 Claims, 9 Drawing Figures

2
3
31
G
N
33
36
35
30
X
Y
E
S
W
11
10
A
M
C
P
H

HAND GRIP DRIVE FOR TORQUE WRENCHES

BACKGROUND OF THE INVENTION

The art of click-type torque wrenches is old and highly developed. Click-type torque wrenches are those torque-indicating wrenches which, when used, emit an audible "click" or striking sound when a predetermined force is exerted through the wrenches onto related work, such as screw fasteners.

Click-type wrenches characteristically include elongate tubular lever arms with front and rear ends. The rear ends of the lever arms are provided with or define manually engageable handles. Work-engaging heads are positioned immediately forward the front ends of the lever arms and have work-engaging parts or portions such as fastener-engaging sockets or socket-engaging projections. The heads have elongate crank arms that project freely rearwardly into and through the forward portions of the lever arms. The forward portions of the cranks are pivotally connected to the forward ends of the lever arms; are normally concentric with the lever arms and are pivoted, when actuated, so that their rear ends strike and stop against inside surfaces of the lever arms and generate or emit an audible sound.

The cranks are releasably held concentric in the lever arms by spring-loaded cam mechanisms within the lever arms rearward of the cranks.

Though the spring-loaded cam mechanisms employed by different manufacturers of click-type wrenches have varied considerably throughout the years, the most common and widely employed cam mechanisms in use today include flat-faced cam blocks normally establishing flat seated engagement with and between flat axially-disposed front and rear cam seats at the rear ends of the cranks and at the forward ends of elongate shiftable, spring-loaded slide blocks in the lever arms. The slide locks are urged forwardly by spring pressure to normally yieldingly hold the cam blocks and cam seats in seated, unactuated positions. When predetermined operating forces are exerted between the wrenches and related pieces of work, the cam blocks are caused to rock or turn between the cam seats and thus permit the cranks to pivot laterally and to strike the insides of the lever arms.

The spring-loaded slide blocks are acted upon by elongate helical compression springs with front and rear ends positioned in the rear ends of the lever arms with their front ends engaging the slide blocks. The rear ends of the springs are engaged by axially adjustable screw mechanisms which are operable to bias the springs axially to exert any desired and/or suitable force onto and through the cam means and to adjust and/or set the wrenches to actuate at any desired operating force, within the operating ranges of the wrenches.

Typically, the screw mechanisms include elongate, axially-shiftable adjusting screws with front and rear ends threadedly engaged through anchor blocks fixed in the rear end portions of the lever arms. The front ends of the adjusting screws are suitably, drivingly coupled or related to the rear ends of the springs and their rear ends are accessible at the rear ends of the lever arms to effect their being turned to effect adjustment of the springs.

Some click-type torque wrenches provided by the prior art are characterized by special and unique cam mechanisms which are distinct from the cam mechanisms briefly described above. In other wrench structures of the character here concerned with, secondary or intermediate pivoted links are provided between the cam mechanisms and the cranks. Such special and unique features and details as might be found in the art in no way alter or affect the present invention. The present invention is concerned with and is limited to that means or mechanism which is provided to effect turning of the adjusting screws at the rear ends of the lever arm of any click-type torque wrench.

Throughout the years, the prior art has sought to provide and to incorporate in click-type torque wrenches manually-operable adjusting mechanisms by which the adjusting screws of the wrenches can be turned to bias the springs in the wrenches to any desired extent and to set the operating forces of the wrenches at selected predetermined force or forces. Typically and substantially all such manually-operable adjusting mechanisms have included a manually-engageable enlargement, accessible at the exterior of the wrench lever arms, at the rear end portions thereof. The enlargements establish axially-shiftable rotary-driving engagement with the adjusting screws. Further, the enlargements typically include calibrations and indicating marks or pointers which cooperate with force-indicating calibrations on or carried by the lever arms.

As a result of the manner in which click-type wrenches are used and the abuse to which they are often times subjected, most, if not all, of the manually-operable adjusting mechanisms provided by the prior art have, to varying degrees, been found and proven to be notably undesireable and/or deficient in certain respects.

For example, in U.S. Pat. No. 3,165,041, issued Jan. 12, 1965, for "Predetermined Torque Release Wrench", a manually-operable adjusting mechanism including a handgrip-type sleeve is rotatably engaged about the rear end of the wrench lever arm. The rear end of the sleeve is drivingly coupled to the rear end of the adjusting screw. The front end of the sleeve is calibrated and cooperates with related calibrations on the lever arm. The sleeve, when not used to adjust the wrench, is held against rotation relative to the lever arm by a manually-releasable ball and detent locking mechanism. In operation and use, the above noted patented structure proved unsatisfactory since the ball and detent locking means was unable to withstand the turning forces exerted onto and through the sleeve during normal use of the wrench structure and that mechanism was so located that accidental release of the locking mechanism was a common experience.

Also, for example, in U.S. Pat. No. 3,581,606, issued June 1, 1971, for "Torque Wrench", a manually-operable adjusting mechanism, including an elongate manually-operable operating knob, was provided adjacent the rear end of the lever arm. The knob carried a calibrated sleeve that slidably entered the rear end of the lever arm and established driving engagement with the adjusting screw. The operating knob of this patented wrench structure proved to be an undesirable obstacle to the safe and effective use of the wrench structure. Specifically, the operators of that wrench structure all too frequently gripped the knob and pulled it out when putting the wrench to normal use. As the knob pulled out, proper manual purchase on the wrench structure was lost and the wrench structure was inevitably moved out of adjustment.

To the best of our knowledge and belief, the most effective and desirable manually-operable adjusting mechanism for click-type torque wrenches provided by the prior art is that adjusting mechanism disclosed in U.S. Pat. No. 3,772,942, issued Nov. 20, 1973, for "Adjustable Torque Wrench." That patented adjusting mechanism includes a strong, durable, molded plastic tubular handgrip, slidably engaged about and normally supported by the exterior of the lever arm, at the rear end thereof. The tubular handgrip has an elongate tubular core that slidably enters the rear end portion of the lever arm. The adjusting screw of the wrench has a polygonal nut at its rear end. The core has a rear opening or bore in which the nut is normally freely positioned and has a forward polygonal opening in which the nut establishes rotary-driving engagement when the handle and core are shifted axially rearward, relative to the lever arm. The inside of the lever arm is grooved (as by a suitable broaching operation) in its rear end portion and the rear portion of the core is formed with splines that enter the grooves when the handle and core are in their forward position and so that the handle or grip is normally locked against rotation relative to the lever arm and is unlocked and free to rotate relative to the lever arm when moved rearwardly (to disengage the splines from within the grooves). The front end of the tubular handgrip is calibrated and cooperates with calibrations on the lever arm, in accordance with common practice in the prior art.

The last above noted prior art wrench structure has been mass produced and has maintained notable commercial success for over fifteen years. Well in excess of one hundred thousand such wrenches have been sold and are in use throughout the world.

The single notable shortcoming found to exist in the above noted prior art wrench structure resides in the tendency of the splines in the grip to be sheared off and for the grip to become unlocked when, in regular use of the wrench structure, a user curls his wrists and pulls on the handgrip and lever arm with great and determined force. While such shearing off of the splines seldom occurs in wrench structures provided to operate throughout low ranges of applied force, it is not infrequent that the splines are sheared off in wrenches provided to operate throughout high ranges of applied force.

In an effort to overcome the above noted shortcoming in the noted prior art wrench structure, splines have been formed in the interior of the lever arms and grooves have been formed in exterior of the core parts of the noted locking mechanism. Thus, a greater mass of material has been provided in the molded plastic part to resist shearing. This effort provided some improvement, but rather than shearing the plastic part, the splines in the lever arms displaced material of the plastic part and collapsed the dore portion thereof when greater than anticipated or excessive turning forces were exerted upon and through the handgrip.

Since the splines and grooves in the above noted prior art structure are inside the lever arm, the mechanical advantage afforded to the turning forces applied to the exterior tubular handgrip is substantial. Further, since the core part in which the splines are formed is held captive within the lever arm, it is not free to yieldingly expand when subjected to high forces and the splines are, therefore, readily sheared off.

It is to be noted that the radial inward displacement of the core part or portion of the plastic part in the subject prior art structure is prevented by the nut part on the adjusting screw. That is the nut part on the adjusting screw supports the core when it is collapsed to a small extent which is insufficient to allow for disengagement of the splines from within their related grooves.

OBJECTS AND FEATURES OF OUR INVENTION

It is an object and feature of our invention to provide an improved and superior manually-operable, adjusting mechanism for click-type torque wrenches which is similar in most respects to that manually-operable adjusting mechanism for click-type wrenches disclosed in U.S. Pat. No. 3,772,942.

It is an object of our invention to provide a mechanism of the general character referred to above wherein the locking mechanism to normally prevent rotation of a molded plastic tubular handgrip about the exterior of the metal lever arm of the wrench structure includes a plurality of circumferentially-spaced, radially outwardly disposed flats about the lever arm, at the rear end portion thereof, and a plurality of circumferential-spaced , radially inwardly disposed flats within the tubular plastic handgrip and which slidably engage and establish flat opposing bearing engagement with the flats on the lever arm when the hand grip is in a normal, forward position on the lever arm and which disengage the flats on the lever arm when the handgrip is shifted to an actuated rear position on the lever arm.

It is another object and feature of our invention to provide an adjusting mechanism of the character referred to wherein the portion of the molded plastic tubular handgrip, in which the flats are formed, is structurally unsupported about its outer perimeter and is free to expand radially outwardly and circumferentially within the elastic limits of the plastic material of which said handgrip is established, when turning forces exceeding the shear forces of said plastic material is applied to the handgrip to cause the handgrip to turn relative to the lever arm.

Still another object and feature of our invention is to provide an adjusting mechanism of the character referred to wherein the molded plastic handgrip and core define an elongate, longitudinally-extending, forwardly-opening annulus with radially-spaced, opposing inside and outside cylindrical surfaces; wherein the tubular lever arm has a rear end portion with outside and inside cylindrical surfaces, longitudinally and rotatedly slidably supported with the inside and outside surfaces in said annulus; wherein the annulus has a rearwardly-extending extension with a polygonal outside surface and said lever arm has a rearwardly-extending extension with a polygonal outside surface; said extension on the lever arm is shiftable longitudinally into and out of rotary-driving engagement in the extension of said annulus.

An object and feature of our invention is to provide an adjusting mechanism of the character referred to wherein the radial distance between the major and minor outside diameters of the polygonal extension of the lever arm is less than the radial distance the plastic handgrip can expand radially outward without exceeding the elastic limits of the plastic material of which the handgrip is made.

It is an object and feature of our invention to provide an adjusting mechanism of the character referred to wherein the longitudinal side edges of adjacent flats on the polygonal extension on the lever arm converge at obtuse angle and define low angle cam lobes that will act upon and move across the flats in the extension of the annulus without scuffing or otherwise physically damaging the surfaces of the flats in the extension of the annulus.

Finally, it is an object and feature of our invention to provide an adjusting mechanism of the character referred to wherein the interengageable, rotary-driving flats of the polygonal extensions of the annulus and lever arm are at the outside radial limits of the lever arm whereby the mechanical advantage of the counter turning forces applied to the exterior surface of the handgrip is reduced to a minimum.

The foregoing and other objects and features of our invention will be apparent and will be understood from the following detailed description of one typical, preferred form and embodiment of our invention throughout which description reference is made to the accompanying drawings.

DETAILED DESCRIPTION OF THE INVENTION

Figures 1, 2:
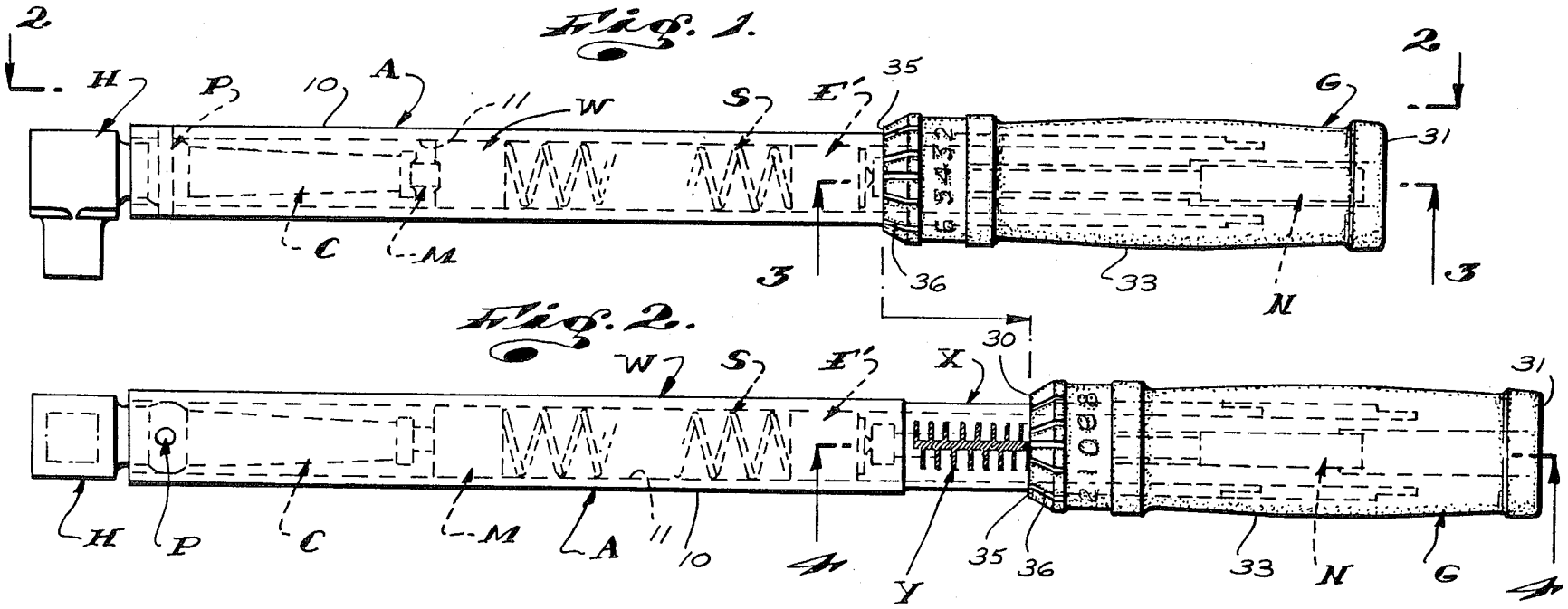
FIG. 1 is a side elevational view of our wrench.
FIG. 2 is a view taken as indicated by line 2—2 on FIG. 1.

Referring to FIGS. 1 and 2 of the drawings, a typical click-type torque wrench structure W embodying our invention is illustrated.

The wrench structure W includes an elongate tubular lever arm A established of hardened steel. The arm A has cylindrical inside and outside surfaces 10 and 11 and has front and rear ends. A typical work-engaging head H is provided adjacent the front end of the lever arm A. The head H has an elongate rearwardly projecting crank C projecting freely rearwardly into and through the forward portion of the arm A and which is normally concentric therewith.

The forward end portion of the crank C is pivotally connected with the front end portion of the lever arm A by a pivot pin P whereby the crank C can be pivoted laterally within the arm A, when the wrench is operated and in accordance with common practice.

Within the arm A rearward of the crank C is a cam mechanism M. The cam mechanism M normally releaseably holds the crank C concentric within the arm A. For the purpose of this disclosure, the cam means M can be and is shown in block diagram form, in dotted lines.

The cam means M, in accordance with common practice, is spring loaded by adjustable spring means S. The springs means S includes an elongate helical compression spring with front and rear ends positioned within the arm A rearward of the cam means M and is biased to exert selected predetermined forces forwardly onto and through the cam means M. The force applied by the spring means S upon the means M determines and sets the operating force of the wrench structure W.

The adjustable spring means S includes an anchor block B fixedly mounted within the arm A rearward of the spring and an elongate adjusting screw D with front and rear ends, concentric within the arm A and threadedly engaged through the block B. An elongate spring back-up block E is slidably engaged in the arm A between the rear end of the spring and the front end of the screw D. The rear end portion of the screw D is accessible at or within the open rear end of the arm A to effect turning of the screw D to adjust biasing of the spring and to thereby adjust the operating force of the wrench structure.

The wrench structure that is illustrated and briefly described above is only intended to illustrate and describe one typical click-type torque wrench structure with which my invention can be advantageously related and is not to be considered as limiting the application and use of my invention to any material extent.

In furtherance of our invention, the rear end portion of the adjusting screw D is provided with an elongate longitudinally extending polygonal (hexagonal) drive nut N. The drive nut N is threadedly engaged on and about the rear end portion of the screw D to project rearwardly therefrom and is releaseably locked against free turning on and relative to the screw D by a set screw 20 and, if necessary, a jamb plug 21 engaged in its rear end portion, as clearly illustrated in FIG. 5 of the drawings.

In practice, the longitudinal position of the drive nut N on the screw D is changed, as desired, to effect fine adjustment of the forces that are exerted by the spring means S on and through the cam means M.

All of the structure thus far described is established of high-grade steel which is carefully and accurately machined, formed and heat treated, as circumstances require.

In furtherance of our invention, the wrench structure next includes an elongate, cylindrical handgrip G with front and rear ends 30 and 31. The grip G has an elongate cylindrical bore entering its front end and terminating in the rear end portion of the grip. The bore defines a radially inwardly opening cylindrical inside surface 32 substantially corresponding in outside diameter with the lever arm A and in which the rear end portion of the lever arm is slidably engaged for substantial free, yet supported, longitudinal and rotary movement.

The exterior 33 of the grip G can be varied in configuration as desired and is preferably formed to establish a comfortable handgrip surface 34. Further, the exterior and/or exposed forward end portion of the handgrip G is preferably formed with a sharp or clearly defined annular reference edge 35 and with reference marks and/or line 36 which cooperate with a calibrated scale on and carried by the lever arm A, as will hereinafter be described and as clearly shown in the drawings.

The structure that we provide next includes an elongate central cylindrical tubular core part F with front and rear ends. The part F is preferably, though not necessarily, formed integrally with the grip G and is positioned concentrically within the bore in said grip G.

The rear end of the core part F is joined with the rear portion of the grip G and projects freely forwardly into the forward portion of the grip G.

The core part F has a cylindrical radially outwardly disposed surface 40 substantially corresponding in outside diameter with the inside diameter of the lever arm A and which is spaced radially inward from and opposes the noted inside surface 32 of the grip G to cooperate therewith and define an elongate longitudinally-extending, axially forwardly opening annulus 41 in which the rear end portion of the arm A is slidably engaged for substantial free, supported, axial shifting and rotation.

Figures 3, 4, 5, 6, 7, 8, 9:
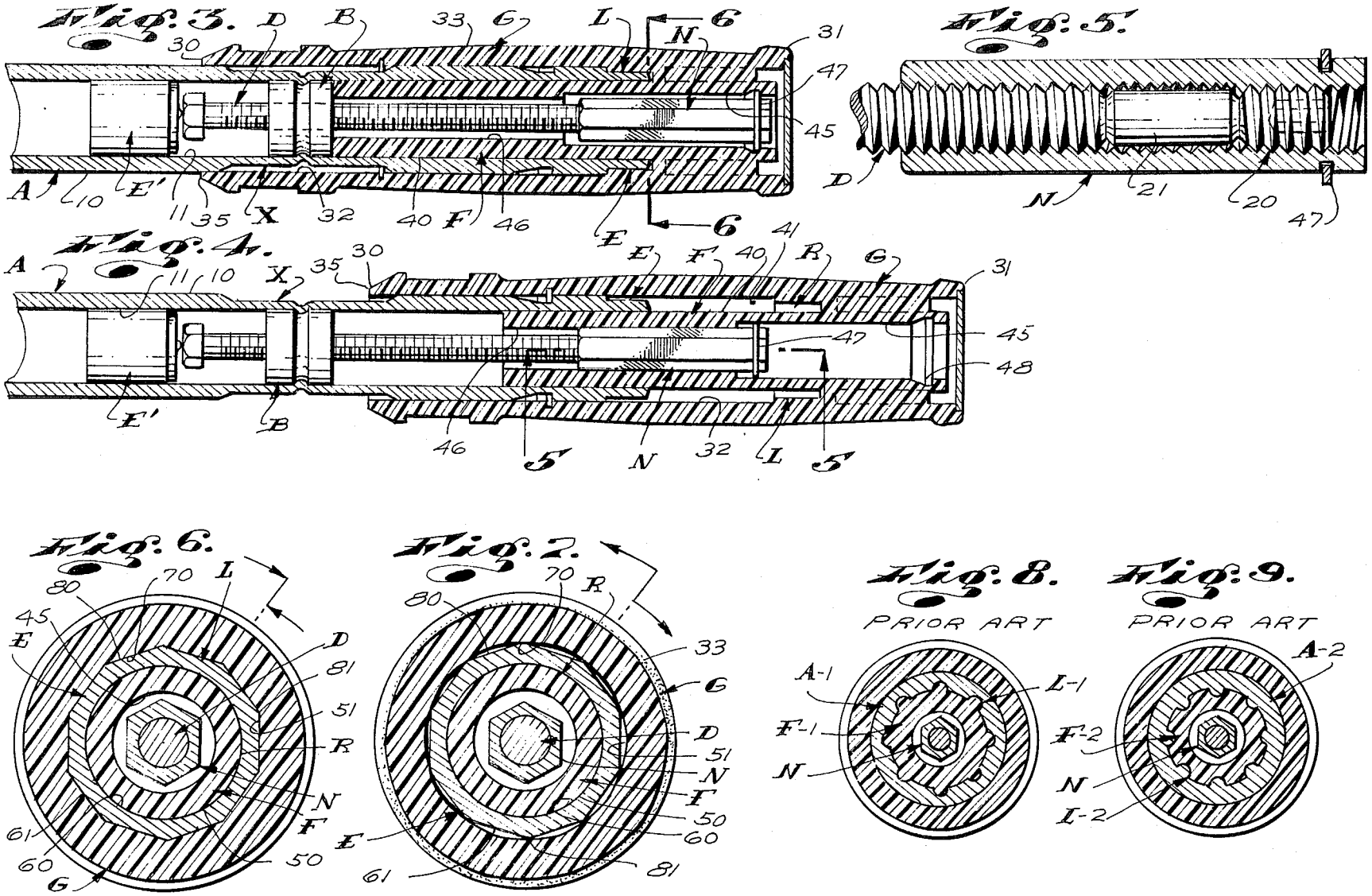
Fig. 8. PRIOR ART
Fig. 9. PRIOR ART
FIG. 3 is an enlarged sectional view taken as indicated by line 3—3 on FIG. 1.
FIG. 4 is an enlarged sectional view taken as indicated by line 4—4 on FIG. 2.
FIG. 5 is a view taken as indicated by line 5—5 on FIG. 4.
FIG. 6 is an enlarged sectional view taken as indicated on line 6—6 on FIG. 3.
FIG. 7 is a view similar to FIG. 6 showing parts in a different position.
FIG. 8 is a cross-sectional view showing one prior art structure.
FIG. 9 is a view similar to FIG. 8 showing another prior art structure.

The rear end portion of the grip G and/or rear end portion of the core F define a central, longitudinally-extending, rearwardly-opening, bore-like opening 45 which is greater in longitudinal extent and greater in diametric extent than the polygonal drive nut N and in which said drive nut is positioned when the construction is in a normal, unactuated position, that is, when the grip G and core F are in a normal forward position on and relative to the arm A, as shown in FIG. 3 of the drawings.

The core F has a central, longitudinally-extending, polygonal opening 46 with open front and rear ends. The opening 46 extends forward from the opening 45 and the adjusting screw D normally extends freely therethrough. When the handgrip is moved to its actuated position, the nut N is slidably engaged in the polygonal opening 46 and establishes rotary-driving engagement between the adjusting screw D and the handgrip and core unit (see FIG. 4 of the drawings).

In practice, to releaseably maintain the grip and core in their normal position, the rear end portion of the nut N carries a radially outwardly projecting, radially-expandable, resilient snap ring 47 that yieldingly enters and is releaseably retained in a radially inwardly opening annular groove 48 entering the opening 45, as clearly shown in FIGS. 3, 4, and 5 of the drawings.

In one prefered carrying out of our invention and as shown in the drawing, that exterior portion of the arm A which is normally covered by the forward portion of the grip G and which is partially uncovered or exposed when the grip G is moved rearwardly to its actuated position, is relieved as at X to accommodate a thin, printed, calibrated scale sheet, or part Y, with which the forward reference edge 35 and calibrating lines or marks on the front end of the grip G are cooperatively related in accordance with old and well-known practices.

The grip G and core F are molded of a suitable, strong, durable and stable plastic material which has a low coefficient of thermal conductivity, is not subject to degradation when exposed to the environmental elements to which the structure is likely to be subjected, and which is sufficiently flexible and/or elastic so as not to be so fragile and/or brittle as to be subject to fracturing and breaking when subjected to harsh and abusive physical treatment. In practice we establish or make the unitary grip and core structure of molded plastic material. That plastic material and certain other equivalent plastic material have a relatively high modulus of elasticity relative to their hardness and dimensional stability and provide a grip structure which is not so soft and/or flexible as to be perceptibly insecure and/or unstable.

With the structure thus far described, it will be apparent that, when the grip G and core F are moved rearward relative to the arm A and the nut N to their actuated position, the nut N and adjusting screw D are turned upon turning or rotation of the grip G relative to the arm A and that biasing of the spring S is varied or adjusted, as desired. The extent to which the spring means S is biased and the resulting operating force of the wrench structure is indicated by the relationship of the edge 35 and marks 36 on the grip G relative to the calibrated scale part Y on the arm A.

When the grip G and core F are moved forward and back to their normal position, the nut N is disengaged therefrom and accidental or inadvertent turning of the nut and upsetting of the adjustment previously made in and to the spring means S cannot occur. However, in the absence of a suitable locking means, the grip and core are free to rotate on and about the arm A and secure and positive manual control of the wrench structure cannot be attained.

In accordance with the above and in furtherance of our invention, we provide new and novel releaseable locking means L to normally lock the grip G and core F against rotation relative to the arm A. The lock means L includes an elongate, longitudinally-extending, forwardly opening annular drive recess R communicating with and extending rearward from the rear end of the annulus defined by the grip G and core F. The recess R has a cylindrical, radially outwardly disposed inside surface 50 defined by the core F and has a polygonal radially inwardly disposed outside surface defining flats 51 within the grip G.

The lock means L next includes an elongate longitudinally-extending, rearwardly projecting, annular drive part or extension E at the rear end of the arm A. The drive part E has a cylindrical inside surface 60, slidably engaged about and supported by the core F, and has a polygonal outside surface 61 with the same number of flats as the recess R, and substantially corresponding in major and minor diametric extent with the major and minor diametric extent of the recess R.

The longitudinal extent of the recess R and drive part E is less than the longitudinal distance the grip moves when shifted between its normal and actuated positions and the recess R and part E are positioned so that the part E is slidably engaged in the recess R in rotary-driving engagement therein when the grip G is in its normal position, and is disengaged from within the recess when the grip is in its actuated position. Thus, when the structure is in its normal position, the grip is locked against rotation relative to the arm A, and when in its actuated position the grip is unlocked and is free to rotate relative to the arm A, as clearly shown in FIGS. 3 and 4 of the drawings.

It is important to note that the polygonal surface 51 of the recess R is defined by its related portion of the grip G which portion of the grip is unconfined and/or unsupported about its exterior by any related structure and which is, therefore, free to yieldingly expand radially outwardly and circumferentially upon the application of radially outwardly directed forces within the grip.

The above is to be distinguished from other locking structures of like nature wherein force-receiving parts are arranged and held captive within related structure in a manner that prevents their yieldingly, elastically expanding, when subjected to applied forces and which are subject to failing and being mutilated when excessive forces are applied thereto.

In operation and as illustrated in FIG. 7 of the drawings, when turning forces applied to the grip G and thence between the grip G and the arm A reach that degree that the shear limits of the plastic material of the grip is approached, the flats 70 move and ride over the cam-like edges 81 defined by the adjacent flat 80 of the part E and the grip is free to rotate, incrementally, about the arm A, without damage or adverse affects to the integrity of the plastic structure. When such turning of the grip about the arm occurs, the portion of the grip about the recess R yieldingly expands to an extent that is well within the elastic limits of the material of which the grip is made.

In carrying out our invention, it has been determined that, if the polygonal parts and/or portions of the lock means are square or hexagonal, the difference between the major and minor diameters of those parts is excessive and is greater than the radial extent to which the grip G can be expanded without exceeding the elastic limits of the material of which it is established, unless the grip is made of such soft and resilient material that it cannot otherwise present a grip which is sufficiently dimensionally stable and rigid to enable a user of the wrench to attain secure control of the wrench.

Further, when the polygonal parts are square or hexagonal, the effective angle of the cam edges 81 of the part E that act upon and move across the flats 51 within the grip are 45° or 30° and are such that the cam edges tend to scuff and mutilate the flats surfaces of the plastic part.

In accordance with the above, it has been determined that the polygonal parts and/or portions of our new lock means should be at least octagonal whereby the effective cam angle is about 22° and are preferably, as shown, decagonal and present an effective cam angle of 18°.

An effective cam angle of 18° has been found to be sufficiently low and "gentle" that, upon repeated cycling of the lock means L, no appreciable degradation of the flats surfaces in the structure occurs.

Further, by employing a decagonal locking means, as shown, the extent to which the grip structure is flexed is slight and little work-hardening and premature failure of the molded plastic structure, as a result of such hardening, is eliminated. Such was clearly found not to be true when hexagonal locking means were tested. It was found that, in the case of octagonal locking means, the problem of scuffing of the flats surfaces and work-hardening of the plastic material was marginal.

While the above is not say or indicate that our locking means L cannot be made to operate when established in hexagonal or octagonal configurations, it is to say that for assured, safe, durable and long-lasting operation an octagonal configuration is more likely to be serviceable and that a decagonal configuration assures safe, durable and long-lasting operation.

In FIGS. 8 and 9 of the drawings, we have illustrated those locking means L1 and L2 which we know are old in the art. In those prior art structures, the interiors of the lever arms A-1 and A-2 are formed with pluralities of circumferentially-spaced, longitudinally-extending, radially inwardly opening grooves formed by means of costly broaching operations and the exteriors of the plastic core parts F-1 and F-2 are formed with circumferentially-spaced, longitudinally-extending, radially outwardly projecting splines that are slidable into and out of rotary-driving engagement in the noted grooves.

In the noted and illustrated prior art structures, the core parts are held captive within the lever arms and, if moved or displaced, they must be displaced radially inward and compacted by externally applied compressive forces that the plastic material, of which the core parts are made, is most capable of receiving. Accordingly, in the noted prior art locking structures, when excessive turning forces are encountered between the arms A-1 and A-2 and their related cores F-1 and F-2, the splines and/or the material defining the grooves formed on or in the cores are sheared off or mutilated and the entire wrench structures, of which the locking means are a part, are rendered inoperative. In experiments conducted with our own prior art wrench structures, we found that substituting polygonal configurations for the spline and groove configurations employed by the prior art met with unsatisfactory results since the force required to collapse and/or displace the plastic material, of which the core parts are established, is sufficiently greater than the shear strength of that material that the external surface material of the core parts was mutilated and displaced when excessive turning forces were encountered. Further, when the material of the core parts was caused to collapse radially inwardly, the core parts collapsed upon and became bound about the lock nuts N, rendering the wrench structures inoperative.

In accordance with the foregoing, it will be appreciated that the new locking means L that we provide constitutes a notable and meritorious advance in the art by utilizing and putting the elasticity of the plastic material employed in the structure to a novel use whereby new, improved and non-obvious results are attained.

Having described only one typical preferred form and application of our invention, we do not wish to be limited to the specific details herein set forth but wish to reserve to ourselves any modifications and/or variations that might appear to those skilled in the art and which fall within the scope of the following claims.

Having described our invention, we claim:

1. In a torque wrench structure including an elongate tubular metal lever arm with front and rear ends, a handgrip at the rear end of the arm, a work-engaging head at the front end of the arm and an elongate axially-extending adjusting screw concentric within and accessible at the rear end of the arm to adjust the operating force of the torque wrech; an improved, manually-operable adjusting mechanism to turn the adjusting screw, including an elongate, tubular handgrip of resilient, plastic material having front and rear ends slidably engaged about and extending longitudinally of the rear end portion of the wrench lever arm for free longitudinal and rotational movement relative thereto; an elongate core of resilient, molded plastic material having front and rear ends slidably entered in the rear end portion of the lever arm with its rear end in fixed longitudinal and rotary-driving engagement with the rear end of the grip, the grip and core are shiftable longitudinally of the arm from a normal forward position to a rear actuated position; a polygonal drive part on the adjusting screw; a longitudinally-extending opening in the rear portion of the core freely accommodating the drive part when the core is in its normal position; a longitudinally-extending polygonal opening in the core slidably receiving and establishing rotary-driving engagement with the drive part when the core is in its actuated position; and, a releaseable lock mechanism locking the grip against rotation relative to the lever arm when the grip is in its forward normal positon and releasing the grip for free rotation relative to the lever arm when the grip is in its rear, actuated position, said locking mechanism includes a plurality of circumferentially-spaced, radially outwardly disposed, inner flats on and about the exterior of the rear end portion of the lever and a plurality of circumferentially-spaced, radially inwardly disposed, outer flats about the interor of the grip and in flat opposing bearing engagement with the inner flats when the grip is in its normal, forward position and out of engagement with the inner flats when the grip is in its rear, actuated position, the adjacent, inner flats on the lever arm establish circumferentially-spaced, longitudinally-extending cam edges that move across the outer flats and yieldingly expand the portion of the grip defining the outer flats radially outward when the grip is forceably rotated about the lever arm when the grip is in its normal position.

2. The structure set forth in claim 1 wherein the radial distance between the major and minor exterior dimensions of the arm where the inner flats occur is less than the maximum radial distance of radial expansion of the grip within the elastic limits of the material of which the grip is established.

3. The structure set forth in claim 1 wherein the arm and grip have at least eight circumferentially-spaced, inter-engageable flats and the adjacent flats on the arm define cam edges that move across the surfaces of the flats in the grip and yieldingly expand the grip radially outward when the grip is forceably rotated relative to the arm when in its normal position.

4. The structure set forth in claim 1 wherein the arm and grip have ten circumferentially-spaced, inter-engageable flats and the adjacent flats on the arm define cam edges that move across the surfaces of the flats in the grip and yieldingly expand the grip radially outward when the grip is forceably rotated relative to the arm when in its normal position.

5. The structure set forth in claim 1 wherein the radial distance between the major and minor exterior dimensions of the arm where the inner flats occur is less than the maximum radial distance of radial expansion of the grip within the elastic limits of the material of which the grip is established, said arm and grip have at least eight flats.

6. The structure set forth in claim 1 wherein the radial distance between the major and minor exterior dimensions of the arm where the inner flats occur is less than the maximum radial distance of radial expansion of the grip within the elastic limits of the material of which the grip is established, said arm and grip have ten flats.

7. The structure set within claim 1 wherein the inside angles between the planes of adjacent inner flats on the lever are obtuse angles and define intermediate cam edges that engage outer flats within the grip when the grip is forcibly rotated about the lever when in its forward position.

8. The structure set within claim 1 wherein the inside angles between the planes of adjacent inner flats on the lever are obtuse angles and define intermediate cam edges with cam angle less than 30° that engage outer flats within the grip when the grip is forcibly rotated about the lever when in its forward position.

* * * * *